US006699136B2

(12) United States Patent
Kuo

(10) Patent No.: US 6,699,136 B2
(45) Date of Patent: Mar. 2, 2004

(54) BILLIARD CUE WITH AIMING EFFECT

(75) Inventor: Melody Kuo, Taichung (TW)

(73) Assignee: Hamson Global Co., Ltd., Taichung (TW)

( * ) Notice: Subject to any disclaimer, the term of this patent is extended or adjusted under 35 U.S.C. 154(b) by 0 days.

(21) Appl. No.: 10/187,979

(22) Filed: Jul. 3, 2002

(65) Prior Publication Data

US 2004/0005932 A1 Jan. 8, 2004

(51) Int. Cl.[7] ..... A63D 15/08
(52) U.S. Cl. ..... 473/44; 473/2
(58) Field of Search ..... 473/44–49, 2

(56) References Cited

U.S. PATENT DOCUMENTS 644,681 A * 3/1900 Page ..... 473/49
935,218 A * 9/1909 Moore ..... 473/47
941,728 A * 11/1909 Preast ..... 473/44
1,018,032 A * 2/1912 Copper et al. ..... 473/49
1,111,497 A * 9/1914 Robinette ..... 473/49
1,252,632 A * 1/1918 Voje ..... 473/44
1,260,173 A * 3/1918 Finney ..... 473/49
1,311,707 A * 7/1919 Palladino ..... 473/49
4,949,965 A * 8/1990 Ross et al. ..... 473/2
5,558,584 A * 9/1996 Brown ..... 473/44
6,251,024 B1 * 6/2001 Summers et al. ..... 437/49

FOREIGN PATENT DOCUMENTS

GB 2219517 * 12/1989

* cited by examiner

*Primary Examiner*—Mark S. Graham
(74) *Attorney, Agent, or Firm*—Troxell Law Office, PLLC

(57) ABSTRACT

Billiard cue with aiming effect, including a slender cue body and a tip adhered to a small diameter end of the cue body. At least one group of aiming marks are disposed on the circumference of the small diameter end of the cue body. When using the cue to shoot a cue ball, the group of aiming marks serve as aiming points aimed at the cue ball, whereby the cue ball can be rotated to different extents. Therefore, a player can more precisely shoot and control the cue ball.

12 Claims, 5 Drawing Sheets

BILLIARD CUE WITH AIMING EFFECT

BACKGROUND OF THE INTENTION

The present invention is related to a billiard cue, and more particularly to a billiard cue with aiming effect. A group of aiming marks are disposed on the cue body. A player can aim the aiming marks at the cue ball to more precisely shoot and control the cue ball.

It has been more and more popular to play billiards. It is critical in billiards to shoot and control the cue ball precisely and stably. That is, in order to achieve a nice shot, a player must be able to accurately aim the cue at the true hitting point.

For a beginner, it is uneasy to aim the cue at the true hitting point and an error often takes place when shooting the cue ball. For an experienced player, it is still necessary to make sure that the cue be aimed at the true hitting point.

SUMMARY OF THE INVENTION

It is therefore a primary object of the present invention to provide a billiard cue with aiming effect. A player can more precisely shoot and control the cue ball.

The present invention can be best understood through the following description and accompanying drawings wherein:

DETAILED DESCRIPTION OF THE PREFERRED EMBODIMENTS

Figure 1:
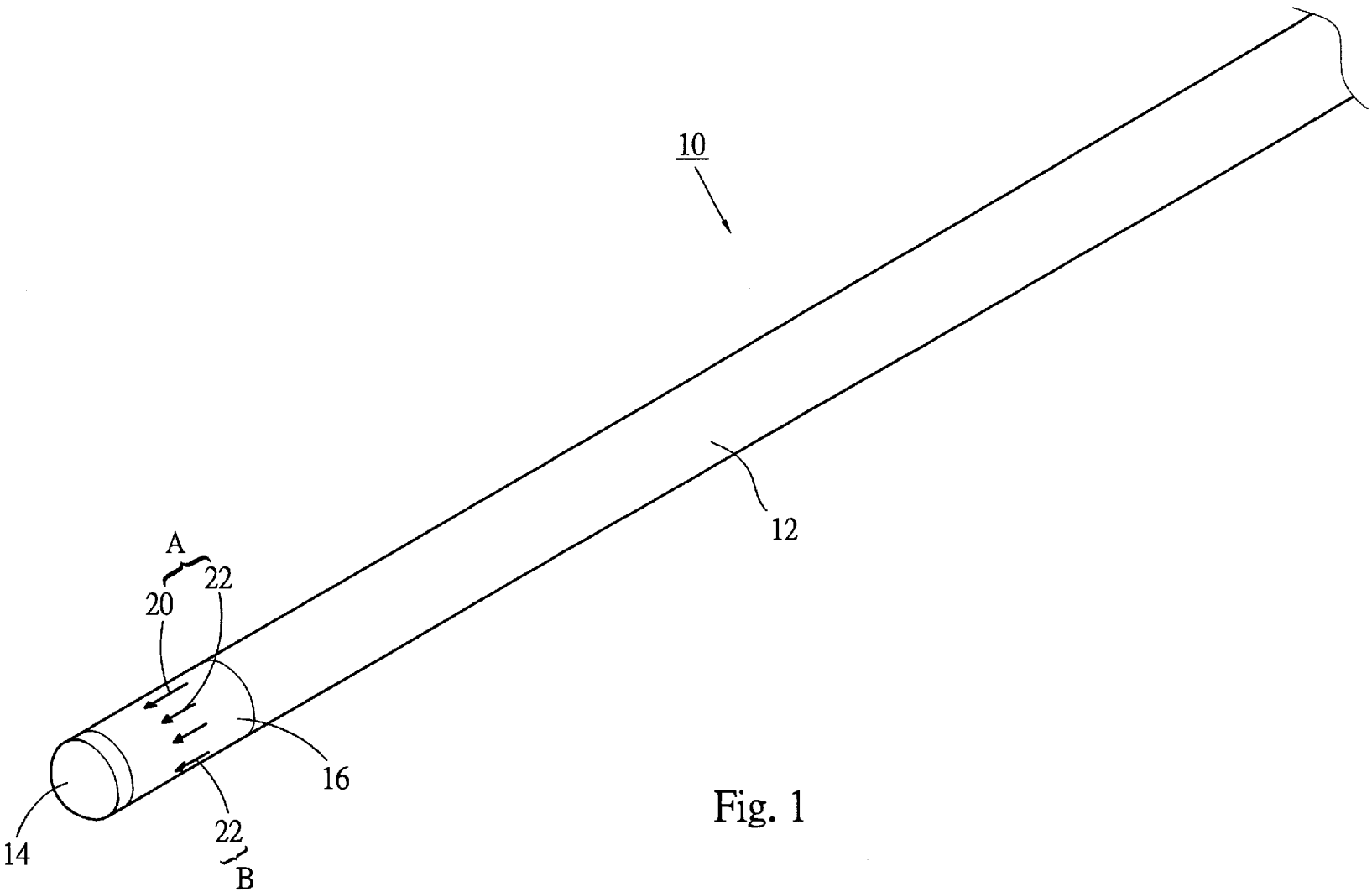
FIG. 1 is a perspective view of a first embodiment of the present invention.

Please refer to FIG. 1 which shows a first embodiment of the billiard cue with aiming effect of the present invention.

The billiard cue 10 includes a conic slender cue body. The cue body can be an integral body or composed of a shaft and a butt. A tip 14 is adhered to front end (small diameter end) of the cue body 12. A ferrule 16 is fitted around the small diameter end of the cue body 12.

Figure 2:
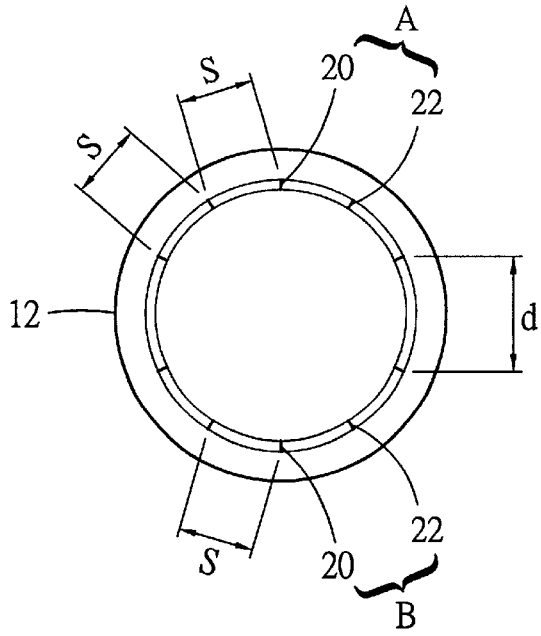
FIG. 2 is an end view according to FIG. 1.

Two groups of aiming marks A, B are disposed on the ferrule 16 as shown in FIG. 2. The two groups of aiming marks A, B are positioned on the same circumference. The first group of marks A are positioned on upper half of the circumference, while the second group of marks B are positioned on lower half of the circumference.

Each group of aiming marks include a main aiming section 20 and several subsidiary aiming sections 22 disposed on two sides of the main aiming section 20. In this embodiment, there are four subsidiary aiming sections 22, that is, there are two subsidiary aiming sections 22 on each side of the main aiming section.

Practically, the main and subsidiary aiming sections 20, 22 can be distinguished in the following manners:

First, the main aiming section 20 has a length (or dimension) larger than that of the subsidiary aiming section 22.

Second, the main aiming section has a color, while the subsidiary aiming section has another color. Each of the above measures enables a player to distinguish the main aiming section from the subsidiary aiming section. In a preferred embodiment, the main and subsidiary aiming sections have different lengths and colors.

In this embodiment, in each group of marks, the main and subsidiary aiming sections are arranged at equal intervals s. The two groups of marks A, B are spaced by an interval d which is slightly larger than interval s. Moreover, the two groups of marks have different colors. By means of the different colors and the intervals d, it is easy to distinguish the two groups of marks.

Figure 3:
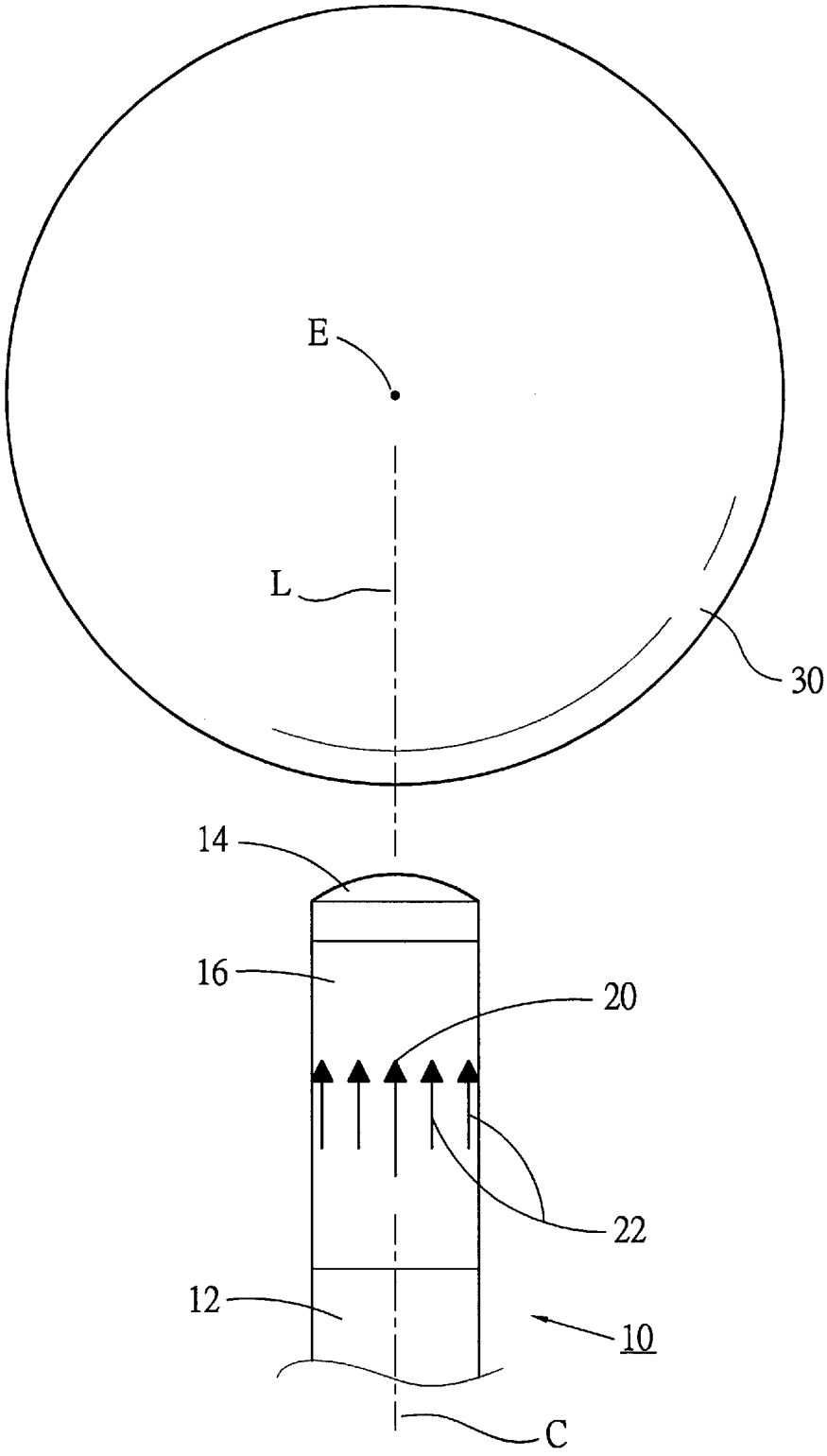
FIG. 3 is a top view according to FIG. 1, showing that the cue is aligned with the center of the cue ball.

In use of the present invention, as shown in FIG. 3, a player can turn the cue 10 to selectively use any group of marks. When aimed, the main aiming section 20 serves as the aiming point for hitting the cue ball. The main aiming section 20 is positioned right at the center of the cue, that is, positioned on the central axis C of the cue. The phantom extending line L of the main aiming section is aligned with the center E of the cue ball 30. Accordingly, when shooting the cue ball, the center of the cue will hit the center of the cue ball so that the cue ball is straightly hit without rotating.

Figure 4:
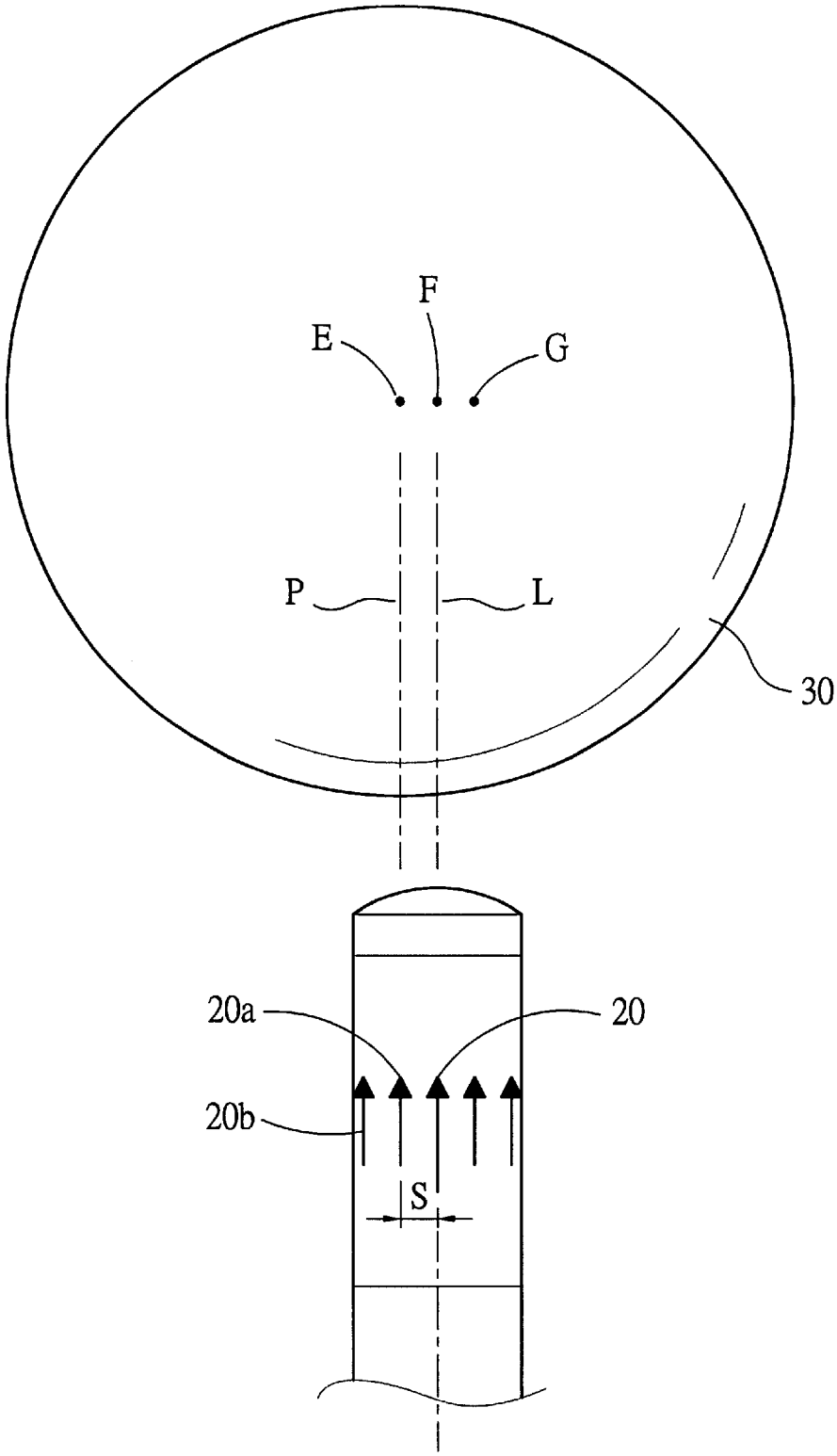
FIG. 4 is a view according to FIG. 3, showing that the cue is displaced from the center of the cue ball for rotationally shooting the cue ball.

When it is desired to rotate the cue ball, the cue is displaced from the center E of the cue ball 30 to one side thereof as shown in FIG. 4. The extending line L of the main aiming section 20 is aligned with a phantom position F of the cue ball, which is displaced from the center E of the cue ball. Accordingly, when hitting the cue ball, a rotating effect is created for controlling the cue ball.

The five aiming sections 20, 22 of each group of marks are arranged at equal intervals s. Therefore, the four subsidiary aiming sections 22 respectively on two sides of the main aiming section serve as scales for rotationally shooting the cue ball. For example, in FIG. 4, when the extending line P of the first subsidiary aiming section 22*a* on left side of the main aiming section is aligned with the center E of the cue ball, the displacement between the hitting point F and the center E of the cue ball is interval s. Therefore, the cue ball will be right-handed rotated by one unit rotational speed. Similarly, when the second subsidiary aiming section 22*b* on left side of the main aiming section is aligned with the center E of the cue ball, the displacement between the hitting point G of the main aiming section 20 and the center E of the cue ball is twice interval s. Therefore, the cue ball will be more strongly right-handed rotated.

Similarly, the subsidiary aiming sections on right side of the main aiming section serve as the scales for left-handed rotationally shooting the cue ball. Accordingly, by means of the subsidiary aiming sections, a player can judge the rotational speed of the shot cue ball.

Figure 5:
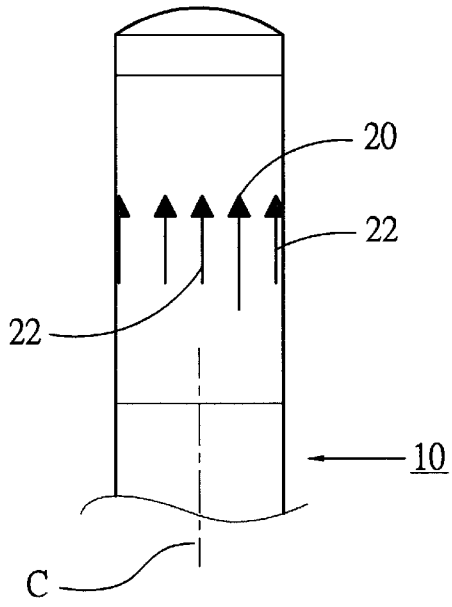
FIG. 5 shows that the cue is not truly positioned.

Also, by means of the subsidiary aiming sections, a player can judge whether the main aiming section 20 is positioned at the center of the cue or not. The main and subsidiary aiming sections 20, 22 are arranged at equal intervals. Therefore, when the main aiming section 20 is positioned at the central axis C of the cue, the subsidiary aiming sections 22 on left and right sides of the main aiming section are symmetrical to each other as shown in FIG. 3. Reversely, as shown in FIG. 5, in the case that the subsidiary aiming sections 22 on left and right sides of the main aiming section 20 are asymmetrical to each other, it is known that the main aiming sect ion is not positioned on the central axis C of the cue 10. Under such circumstance, the player needs to turn the cue back to the state as shown in FIG. 3 to position the main aiming section on the central axis of the cue. Only at this time, the main aiming section serves as the aiming point for shooting the cue ball. Therefore, by means of observing whether the subsidiary aiming sections on two sides of the main aiming section are symmetrical to each other, the player can judge whether the main aiming section is right positioned at the center of the cue.

Figure 6:
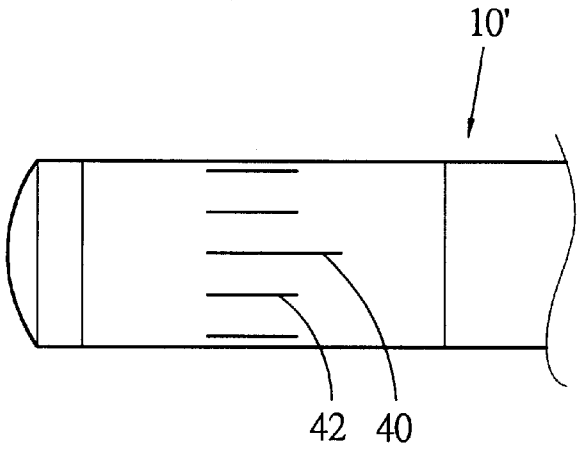
FIG. 6 is a top view of a second embodiment of the present invention.

FIG. 6 shows a second embodiment of the present invention, in which the main and subsidiary aiming sections 40, 42 are straight lines instead of the arrows of the first embodiment. Also, the main aiming section 40 has a length larger than that of the subsidiary aiming section 42. In addition, the main and subsidiary aiming sections 40, 42 have different colors.

In the first and second embodiments, the lengthwise direction of the aiming sections 20, 22, 40, 42 is parallel to the axis of the cue 10, 10'.

Figure 7:
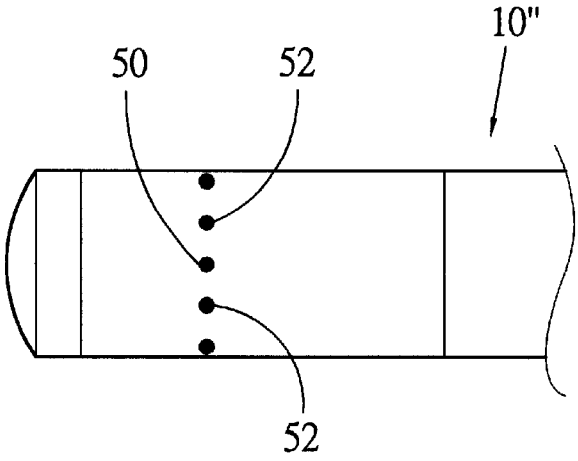
FIG. 7 is a top view of a third embodiment of the present invention.

FIG. 7 shows a third embodiment of the present invention, in which the aiming sections 50, 52 are dots and have different colors.

It should be noted that the configurations of the aiming sections are not limited to the above embodiments. For example, the aiming sections can be triangular.

Furthermore, in the case that two groups of aiming marks are disposed on the cue, the two groups of aiming marks can have different configurations. For example, one group of marks are arrows, while the other group of marks are straight lines or dots.

The present invention is characterized in that the aiming marks disposed on the cue enable a player to more precisely aim the cue at the true hitting point of the cue ball so as to shoot and control the cue ball better. By means of the present invention, a beginner can more quickly have the tips of aiming so that the learning time can be shortened. Also, with the present invention, an experienced player can more precisely check the hitting point and enhance the accuracy in shooting.

The above embodiments are only used to illustrate the present invention, not intended to limit the scope thereof. Many modifications of the above embodiments can be made without departing from the spirit of the present invention.

What is claimed is:

1. A billiard cue with aiming effect comprising: a conic slender cue body and a tip adhered to a small diameter end of the cue body, the billiard cue having at least one group of aiming marks on a circumference of the small diameter end of the cue body near the tip, the at least one group of aiming marks including a main aiming section and at least four subsidiary aiming sections respectively spaced on opposing sides of the main aiming section, the at least one group of aiming marks being positioned on one half of the circumference of the cue body; whereby when using the cue to shoot a cue ball, the group of aiming marks are aimed at the cue ball.

2. The billiard cue with aiming effect as claimed in claim 1, wherein the main aiming section has a dimension larger than that of the subsidiary aiming sections, and the main aiming section has a color different from that of the subsidiary aiming sections.

3. The billiard cue with aiming effect as claimed in claim 1, wherein the main aiming section has a dimension larger than that of the subsidiary aiming sections.

4. The billiard cue with aiming effect as claimed in claim 1, wherein the main aiming section has a color different from that of the subsidiary aiming sections.

5. The billiard cue with aiming effect as claimed in claim 1, wherein the main and subsidiary aiming sections are arranged at equal intervals.

6. The billiard cue with aiming effect as claimed in claim 1, wherein the main and subsidiary aiming sections each have a form of an arrow, a longitudinal direction of each of the main and subsidiary aiming sections being parallel to an axis of the cue body.

7. The billiard cue with aiming effect as claimed in claim 1, wherein the main and subsidiary aiming sections are each a straight line, a longitudinal direction of each aiming section being parallel to an axis of the cue body.

8. The billiard cue with aiming effect as claimed in claim 1, wherein the main and subsidiary aiming sections are each a dot.

9. The billiard cue with aiming effect as claimed in claim 1, further comprising a ferrule fitted around the small diameter end of the cue body, the at least one group of aiming marks being disposed on the circumference of the ferrule.

10. The billiard cue with aiming effect as claimed in claim 1, wherein the at least one group of aiming marks includes two groups of aiming marks, wherein one group of aiming marks are positioned on a half of the circumference of the cue body, while the other group of aiming marks are positioned on the other half of the circumference of the cue body.

11. The billiard cue with aiming effect as claimed in claim 10, wherein the main and subsidiary aiming sections of the two groups of aiming marks have different configurations.

12. The billiard cue with aiming effect as claimed in claim 10, wherein the two groups of aiming marks have different colors.

* * * * *